United States Patent [19]

Kepchar

[11] 4,138,672

[45] Feb. 6, 1979

[54] MEANS FOR CONNECTING A DISPLAY IN A CIRCUIT

[75] Inventor: Michael W. Kepchar, Stamford, Conn.

[73] Assignee: General Time Corporation, Thomaston, Conn.

[21] Appl. No.: 782,907

[22] Filed: Mar. 30, 1977

[51] Int. Cl.[2] ..... G08B 5/36

[52] U.S. Cl. ..... 340/378.1; 340/380; 340/782

[58] Field of Search ..... 313/500, 510; 340/378 R, 380, 324 M

[56] References Cited

U.S. PATENT DOCUMENTS

| | | | |
|---|---|---|---|
| 3,786,499 | 1/1974 | Jankowski | 340/378 R |
| 4,000,437 | 12/1976 | Lederhandler | 313/500 |
| 4,019,196 | 4/1977 | Teshima | 313/500 |
| 4,039,890 | 8/1977 | Bailey | 313/500 |

*Primary Examiner*—Harold I. Pitts
*Attorney, Agent, or Firm*—Pennie & Edmonds

[57] ABSTRACT

An electrical display device in the form of a light emitting diode is included in an electrical circuit by means of a plate having a conductive surface. The diode is supported by a conductive elastomer on a terminal of said circuit and a second conductive elastomer is supported on a second terminal. The plate conductive surface is received on to span said diode and second conductive elastomer. Means are provided to maintain the conducting elements in circuit arrangement.

4 Claims, 2 Drawing Figures

MEANS FOR CONNECTING A DISPLAY IN A CIRCUIT

BACKGROUND OF THE INVENTION

The present invention is in the field of display apparatus having capability of displaying alpha-numeric characters as selected by the electrical activation of one or more of a plurality of light emitting diodes (hereinafter "LED"). Visual displays and the manner and means for selectivity of the display are known in the prior art. Representative of the prior art is Jankowski et al. U.S. Pat. No. 3,786,499 which describes a package for selectively displaying characters, as above, whereby light from an LED or a plurality thereof each of which defines a point light source may be perceived at a viewing plane at the end of a light pipe whose outline at the plane may be segmentary or of any particular shape as determined by the character to be displayed. The particulars of the apparatus briefly described and more particularly described in the Jankowski et al. patent as well as others similar thereto are well known in the prior art.

The present invention is an improvement over the structure such as disclosed by Jankowski et al. Particularly, the present invention is directed to an improvement in the manner of electrical connection of each LED in an electric circuit whereby it may be selectively energized for reasons as have been pointed out. In Jankowski et al. each LED is indicated as being connected by a first electrical connection as by soldering to the substrate upon which it is supported while the other electrical connection is provided by a wire at the top surface of each LED which is connected to a conductive post. The conductive post is the common terminal. It has been found that one of the most fragile points of an LED for use in a display is the wire bonding of the base chip to a conductor and its connection to the common terminal. To this end the wire may be of a diameter of about 0.001 inch and as such, it requires the exercise of extreme care in the technique, such as soldering or the equivalent, so that the LED may be connected into a circuit whereby it may be energized. The criticality of this operation introduces production costs and the fragility of the connection is a source of problems throughout the life of the display apparatus. Thus, improper handling, excessive vibration or shock or a host of other occurrences may cause the connection either to break loose from the post to which it is connected or break loose from the LED itself.

BRIEF DESCRIPTION OF THE INVENTION

The present invention pertains to a display apparatus capable of providing selectively a display of one or more of a plurality of alpha-numeric characters. More particularly, the present invention pertains to an improvement in apparatus of this type, and particularly in the manner by which a LED may be connected "with the outside world."

The connection may be made with relative ease in manufacture, by inexperienced personnel and once made the connection will be a positive connection throughout the life of the apparatus thereby to obviate any faults which may be occasioned by shock, etc.

As a particular aspect of the invention, the wire which heretofore connected the LED into an electric circuit is replaced by a transparent plate carrying a conductive coating on one side having a thickness which does not substantially militate against transparency. The plate with the conductive coating disposed toward a printed circuit board is positioned in spaced relation to the printed circuit board which carries a printed circuit as may be conventionally applied, the spacing permitting receipt therebetween of conductive elastomeric means. The elastomeric means is formed by a plurality of pads, one of which is supported on a land at a common terminal while the other is supported on a land in the circuit and in turn supports the LED on an upper surface. A package including a light pipe for communicating reflectively the light from the LED to a viewing plane will be received around the conductively coated plate and secured to the printed circuit board in a conventional manner.

Other aspects of the invention will appear as the description continues.

DESCRIPTION OF THE INVENTION

Figure 1:
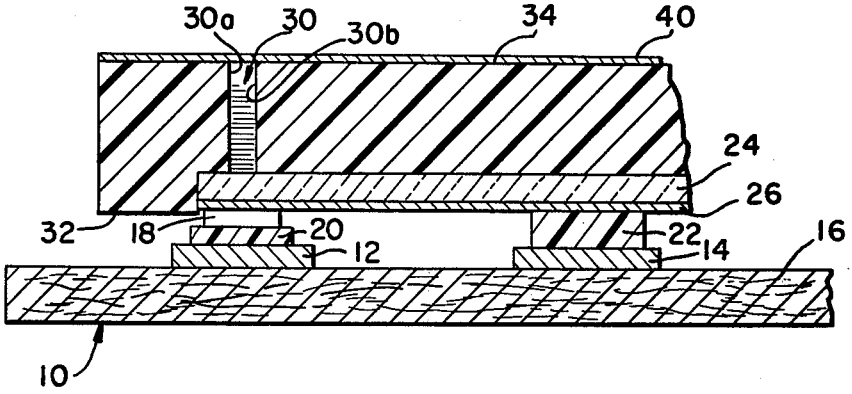
FIG. 1 is a view in vertical section, illustrating the display apparatus of the present invention and the manner by which an LED may be electrically connected in an electric circuit.

FIG. 1 of the drawing illustrates to best advantage the manner of electrically connecting an LED in an electric circuit. Particularly, FIG. 1 illustrates a portion of a printed circuit board 10 of any size and makeup which supports a printed circuit (not shown) although represented by the lands 12 and 14. The structural features as illustrated in FIG. 1 are not to scale and in fact are of exaggerated size and appearance for purposes of a better understanding of the invention. The printed circuit board 10 comprising a substrate and the printed circuit, that is its manner of application to surface 16 are conventional. Accordingly, and since these techniques are outside of the scope of the present invention, further discussion will not be devoted to the same.

The LED 18 comprising one of a plurality of LED's laterally removed one from another as required by the display desired is disposed above each land and supported by a conductive elastomer. The conductive elastomer is formed by a pad 20 comprised of silicone rubber, an epoxy or any of the rubber substitutes, such as neoprene, urethane, vinyl and butyl rubber. Suitably the pad will contain a conductive material such as carbon, silver, gold, tin, conductive oxide and so forth which preferably is deposited or impregnated therein in a finely divided particulate state and in an amount sufficient to establish an electrical path. In the preferred embodiment, the pad 20, formed of a silicone rubber containing carbon particulate as per the disclosure in Seeger, Jr., et al., U.S. Pat. No. 3,861,135, is supported by land 12.

A second pad 22, like pad 20, is supported on the land 14 which functions as the common terminal to which each of a plurality of LEDs may be connected.

Electrical connection between the lands 12 and 14 including LED 18 and pads 20 and 22 is provided by means of a plate 24 providing on one side a conductive coating 26. The plate 24 may be formed of glass or other transparent medium for purposes of passing without substantial diffusion of light, the light from each of the several LEDs 18. The conductive coating 26 may comprise tin, indium oxide or other conductive material capable of being applied as a film to a surface. The application of the conductive material may be carried out in accordance with conventional processes such as vacuum deposition, electroplating and the like. Preferably the plate will be formed of glass and the conductive coating will be tin, while the thickness of the film will be only a few angstroms. In this manner the film surface will provide a conductive path yet the film will be of such a thickness to not substantially militate against good optical transmittance.

Figure 2:
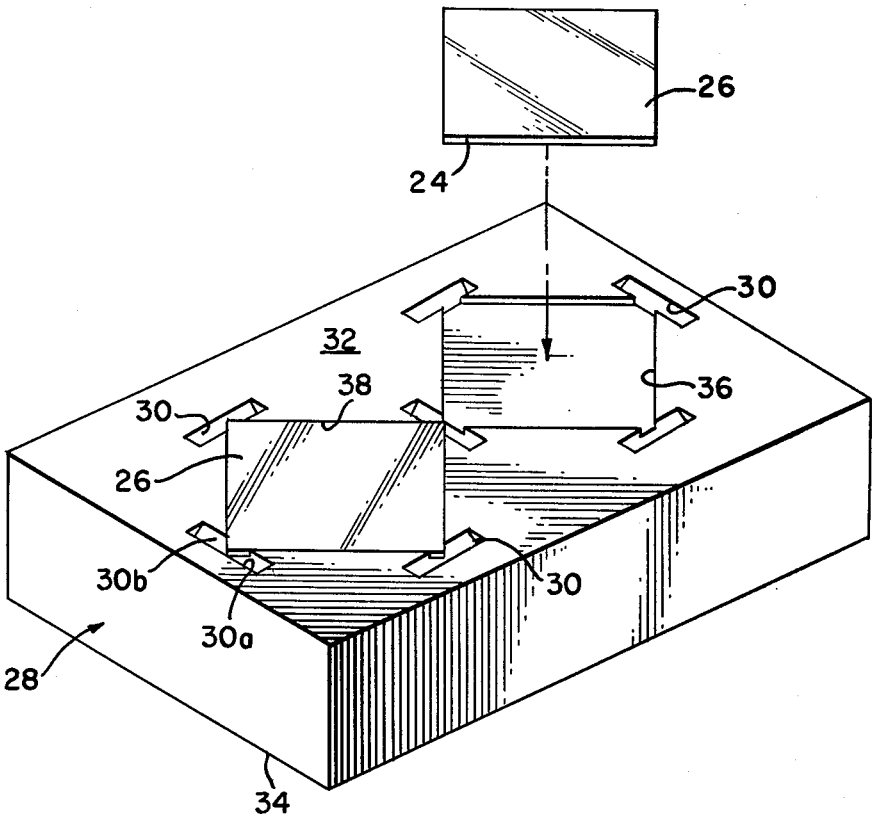
FIG. 2 is a view in perspective of the package for supporting the conductive plate rotated through an angle of 180° from that as illustrated in FIG. 1 thereby to illustrate the manner of supportive receipt of the conductive plate.

Turning to FIG. 2, there is illustrated a package 28 in the form of a block including a number of light pipes 30 for passing light from each LED 18. The light pipes extend between a lower face 32 and an upper parallel face 34. The light pipes 30, at the lower face 32 are of rectangular outline with one pair of opposite internal surfaces being substantially parallel throughout their length and substantially perpendicular to each face while the other pair of internal surfaces diverge outwardly such that the light pipe at the surface 34 is of extended rectangular outline. In the figure illustrated, the light pipes are configured so that the display will be formed by a plurality of segments of illumination which through selective activation will provide both alpha and numeric characters. The segments, also might be of a more artistic outline, as desired thereby to provide alpha-characters in lower case, for example. The interior walls of the light pipe are preferably reflective thereby to provide good transmission for light from each light source defined by an LED 18.

As illustrated, the light pipes are arranged in the form to provide by selective illumination of one or more LED's each of the numeric characters from 0 to 9.

Referring again to FIG. 2, it will be noted that the block 28 is provided with a cut-out 36 which spans the area of the light pipes within the region of one-half of the block. A second cut-out 38 spans the area of the light pipes within the other half of the block. The cut-out 36, as well as the cut-out 38, is formed to a depth thereby to receive the plate 24 so that it is substantially planar with the remainder of the surface of the block. These features may be appreciated by virtue of one plate being illustrated in position within the cut-out 38 while a second plate is illustrated exploded out of the cut-out 36. The plates may be of any particular shape, for example, the shape of a rectangle, as in the preferred form of the invention, and all that is required is that the plate overlie each LED 18 associated with the individual light pipes and the land 14 which functions as the common terminal. The block 28 may support two plates providing continuity therebetween with a single land 14, a single plate or a multiple of plates for including in an electrical circuit a group of LED's which may be selectively energized. The block preferably will be of plastic as well known and capable of being molded to a desired shape and including the cut-outs and light pipes.

The block 28 may be received over the printed circuit board 10 and secured to the board by any means as is conventional in the art, such as by means of a separate casing (not shown) received therearound or by means of an epoxy or the equivalent which will secure the lower surface 32 around the perimeter of block 28 to the surface 16 of printed circuit board 10. As indicated previously, the showing in FIG. 1 is by no means to scale and in the manufactured form of the apparatus there would be only a small distance between the surfaces 16 and 32. By virtue of this type of mounting of the block 28 to the printed circuit board 10 there will be a slight compression of the conductive elastomeric pads 20 and 22 so that the LED 18 will be held in position at the land 12 and in a position centered to the opening into the respective light pipe 30 at the surface of cutout 36 and 38 in the lower surface 32.

The viewing surface may be provided by a translucent member 40 secured to the surface 34 of block 28. The translucent member may be secured to the block in any convenient manner and enhances the display as selectively activated. The translucent member preferably is formed of a plastic material and may be white, red, clear, frosted, or of any color desired in the application of the display.

Although it has not been illustrated in the figures, the display also may include additional light pipes for purposes of displaying a decimal point or the like.

Having described the invention with particular reference to the preferred form thereof, it will be obvious to those skilled in the art to which the invention pertains after understanding the invention, that various changes and modifications may be made therein without departing from the spirit and scope of the invention as defined by the claims appended hereto.

What is claimed is:

1. A read-out device having capability of display of one or more of a plurality of alpha-numeric characters by means of electrical energization of selected ones of an array of light-emitting diodes, each diode providing a point source of light corresponding to a segment of each character when electrically energized, comprising a circuit board providing thereon said array of diodes, electrical circuit means supported on said circuit board adapted to be connected to a source of power whereby each said diode may be energized, means for passing light from each said diode which shall have been energized to a viewing surface thereby to provide a display formed of those segments required for each character, and wherein the improvement comprises connector means for electrically connecting each said diode in an electrical circuit, said connector means including a transparent element plate-like in form carried on and extending between at least one of said diodes and common terminal means of said electrical circuit means, said connector means having a continuous conductive metallic coating on one side thereby to contact each said diode and said common terminal means, and said light passing means maintaining said connector means in said position.

2. The read-out apparatus of claim 1 wherein said electrical circuit means includes elastomeric conductive means, said elastomeric conductive means being formed by a plurality of pads equal in number to the number of diodes, one pad received on a land of said electrical circuit for supporting said diode, and said common terminal means including a pad.

3. The read-out apparatus of claim 2 including a cut-out formed in a surface of said light-passing means which shall face said circuit board, said cut-out being of a size to receive said plate-like member so as not to extend beyond the plane of the remainder of said plate-like member, and means for securing said plate-like member to said circuit board.

4. The read-out apparatus of claim 1 wherein said conductive metallic coating is of a thickness no more than about a few angstroms so as to not cause said connector means to lose more than an inconsequential amount of its transparency characteristic.

* * * * *